US009190724B2

(12) United States Patent
Turbiner

(10) Patent No.: US 9,190,724 B2
(45) Date of Patent: Nov. 17, 2015

(54) PHASED ANTENNA ARRAY FOR GLOBAL NAVIGATION SATELLITE SYSTEM SIGNALS

(71) Applicant: CALIFORNIA INSTITUTE OF TECHNOLOGY, Pasadena, CA (US)

(72) Inventor: Dmitry Turbiner, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 403 days.

(21) Appl. No.: 13/926,970

(22) Filed: Jun. 25, 2013

(65) Prior Publication Data

US 2013/0342397 A1 Dec. 26, 2013

Related U.S. Application Data

(60) Provisional application No. 61/664,312, filed on Jun. 26, 2012.

(51) Int. Cl.
*H01Q 1/36* (2006.01)
*H01Q 3/26* (2006.01)
*H01Q 21/00* (2006.01)

(52) U.S. Cl.
CPC ..... *H01Q 3/26* (2013.01); *H01Q 1/362* (2013.01); *H01Q 21/0087* (2013.01); *Y10T 29/49016* (2015.01)

(58) Field of Classification Search
CPC ..... H01Q 21/0087; H01Q 3/26; H01Q 1/362
USPC ..... 343/700 MS, 853, 867, 878, 895
See application file for complete search history.

(56) References Cited

U.S. PATENT DOCUMENTS

| | | | | | |
|---|---|---|---|---|---|
| 3,044,063 | A * | 7/1962 | Russell | G01S 1/02 | 342/374 |
| 4,414,550 | A * | 11/1983 | Tresselt | H01Q 9/0407 | 342/373 |
| 4,680,591 | A * | 7/1987 | Axford | H01Q 1/40 | 343/853 |
| 5,173,711 | A * | 12/1992 | Takeuchi | H01Q 9/0421 | 343/700 MS |
| 5,485,170 | A * | 1/1996 | McCarrick | H01Q 1/3275 | 343/713 |
| 6,480,173 | B1 * | 11/2002 | Marino | H01Q 1/36 | 343/778 |
| 6,828,935 | B1 | 12/2004 | Dunn et al. | | |
| 2003/0030594 | A1 * | 2/2003 | Larry | H01Q 11/08 | 343/895 |

* cited by examiner

*Primary Examiner* — Tho G Phan
(74) *Attorney, Agent, or Firm* — Steinfl & Bruno LLP

(57) ABSTRACT

Systems and methods for phased array antennas are described. Supports for phased array antennas can be constructed by 3D printing. The array elements and combiner network can be constructed by conducting wire. Different parameters of the antenna, like the gain and directivity, can be controlled by selection of the appropriate design, and by electrical steering. Phased array antennas may be used for radio occultation measurements.

20 Claims, 8 Drawing Sheets

PHASED ANTENNA ARRAY FOR GLOBAL NAVIGATION SATELLITE SYSTEM SIGNALS

CROSS REFERENCE TO RELATED APPLICATIONS

The present application claims priority to U.S. Provisional Patent Application No. 61/664,312 filed on Jun. 26, 2012, the disclosure of which is incorporated herein by reference in its entirety.

STATEMENT OF GOVERNMENT GRANT

The invention described herein was made in the performance of work under a NASA contract, and is subject to the provisions of Public Law 96-517 (35 USC 202) in which the Contractor has elected to retain title.

TECHNICAL FIELD

The present disclosure relates to antenna structures for global navigation satellite systems. More particularly, it relates to phased antenna arrays, such as phased antenna arrays for global navigation satellite system signals.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DESCRIPTION

Figure 1:
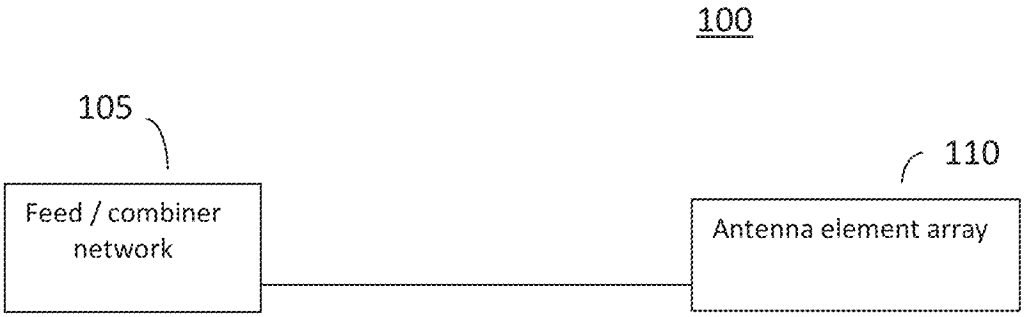
FIG. 1 depicts a phased array antenna system.

Radio occultation is a versatile measurement technique which can be applied, for example, to meteorological studies of the atmosphere of a planet. Radio occultation occurs when a satellite, for example a satellite belonging to the global navigation satellite system (GNSS) which comprises, among others, the GPS constellation, becomes obscured by the planet, relative to a GNSS signal receiver. For example, a GNSS receiver might be a low earth orbit (LEO) satellite. A GNSS satellite, such as a GPS satellite orbiting Earth, can become occulted when it 'sets' below the Earth's horizon, relative to the LEO satellite. When such radio occultation occurs, the LEO satellite cannot receive the GPS radio signal anymore on a direct, straight line. However, the LEO satellite can still receive the radio signal due to the bending of the radio signal caused by the planet's atmosphere. A GNSS receiver does not need to be a LEO satellite, it may also be ground-based. In one embodiment of the disclosure, several inexpensive ground-based GNSS receivers permit efficient radio occultation measurements. In other embodiments, the antennas described in the present disclosure may also be used for general (non GNSS) signal receiving and transmitting.

For the purpose of a general explanation, a distinction can be made between a planet's atmosphere which contains various gases, such as oxygen, nitrogen and water vapor, and an outer region called the ionosphere. When a GNSS radio signal travels to a receiver, it will be influenced by several factors, such as the electron density in the ionosphere, and the pressure, temperature, density and water vapor content of the atmosphere.

When the GNSS radio signal traverses the ionosphere and the atmosphere, it is therefore bent along a curved path, and then received by, for example, a LEO satellite. The signal received along a curved path will have different phase and amplitude relative to a signal received in a straight line from the GNSS satellite. This signal difference can be analyzed and give valuable information on different parameters describing the atmosphere, which can be used, for example, in meteorological research and forecasting.

GNSS radio occultation measurements can give an almost instantaneous measurement, and due to the relative motion of the satellites, such measurements can allow vertical scanning of successive layers of the atmosphere.

For radio occultation, or any other radio application, it may be advantageous to use high gain antennas. Such antennas are able to transmit and/or receive signals at higher power, therefore with a higher signal strength, relative to antennas with a lower gain. As known to the person skilled in the art, the gain is an important parameter of an antenna, which describes the electrical efficiency combined with the directivity of the antenna. In other words, the gain describes how well an antenna converts input power into output radio waves in a specific direction (when transmitting), or how well an antenna converts input radio waves from a specific direction into output power (when receiving).

The present disclosure relates in particular to radio signals which are circularly polarized, therefore it describes circular polarization high gain antennas, which display a high gain over a wide range of frequencies (broadband). The antennas of the present disclosure are phased array antennas. As known to the person skilled in the art, phased array antennas comprise an array of active elements, each transmitting a signal. The signal of each individual antenna element is regulated in such a way as to create constructive and destructive interference patterns, therefore enhancing the overall signal strength in certain directions rather than in others. It is therefore possible to transmit a highly directional radio signal through the controlled output of an array of elements. As it is known in the art, the phase of the signal determines the constructive or destructive interference, therefore such arrays are called phased array antennas. A similar mechanism also works in the receiving mode of the phased array antennas. An example is described in U.S. Pat. No. 6,828,935, the disclosure of which is incorporated herein by reference in its entirety.

The antenna elements of the present disclosure are broadband and have high efficiency, low mutual coupling, a specific input impedance, and can be oriented to point their individual beam in arbitrary directions. Portions of the array can form sub-arrays which can be controlled independently of other sub-arrays, for specific applications.

By selecting the appropriate gain for each antenna element, as well as the appropriate array geometry and phase and amplitude differences between the signals of each antenna element, it is possible to maximize the effective aperture of the phased array antenna. In such a way, it is also possible to tune the directivity pattern of the antenna, in order to distribute the signal gain peaks in a desired way.

As known in the art, the effective aperture of an antenna relates to the efficiency of the antenna. Across a cross-section area of space, a signal will have a specific intensity per area. This constitutes the maximum theoretical intensity that can be collected in that area. A real antenna will have a high efficiency if it is able to collect a high portion of the signal intensity going through that area. In space application, the volume available for an antenna is often limited. The constraint of having the maximum efficiency possible for the available volume is then paramount for effective space deployment. The phased antenna arrays of the present disclosure have been optimized for having the highest maximum efficiency within the volume constraint allocated to the antenna in the specific astronautical mission.

Satellite communication systems often use circularly polarized radio waves, in order for the satellite antenna to be able to transmit signals regardless of the antenna orientation. The satellite antenna may then be oriented at any angle in space without affecting the transmission. Axial mode helical antennas are often used at the receiving end. Helical antennas typically comprise a conducting wire wound in a helical shape.

According to a first aspect of the disclosure, a phased array antenna is disclosed, the phased array antenna comprising: a three-dimensionally printed support structure, wherein the support structure comprises a base structure lying on a ground plane, and further comprises an array of support elements protruding away from the ground plane; an array of active elements, comprising a first conducting wire wound around the array of support elements, wherein a phase of a radio wave emitted by the active elements of the array of active elements is adjustable; and a combiner network, comprising a second conducting wire connecting to the first conducting wire, configured so that a beam pattern of the radio wave can be steered in a desired direction by way of phase adjustment.

As illustrated in FIG. 1, an embodiment of a phased array antenna system (100) may comprise an electrical feed network (105), designed for minimum loss. Such network may allow operation of the phased array antenna (100) without the use of an impedance matching network or a non-optimal transmission line. The low-loss feed network (105) may be especially advantageous for satellite applications as satellites may have a limited availability of electrical power. Therefore, achieving a high electrical efficiency is also paramount for astronautical applications.

The phased array antenna system (100) may be designed to allow the use of low-cost 3D printing components and inexpensive assembly, as explained below in the present disclosure.

The embodiment of FIG. 1 further comprises an array of helical elements (110). The feed network (105) is designed to provide proper phasing and impedance matching between the antenna elements (110). The feed network (105) may also be termed a combiner network, as it combines the array elements (110). The combiner network (105) controls the individual array elements, combining their phases in the desired pattern for the specific application, as it is known in the art, for example in U.S. Pat. No. 6,828,935.

In one embodiment, a phased array antenna comprises 12 helical elements, divided in 3 sub-arrays, each comprising 4 helical elements.

Figure 2:
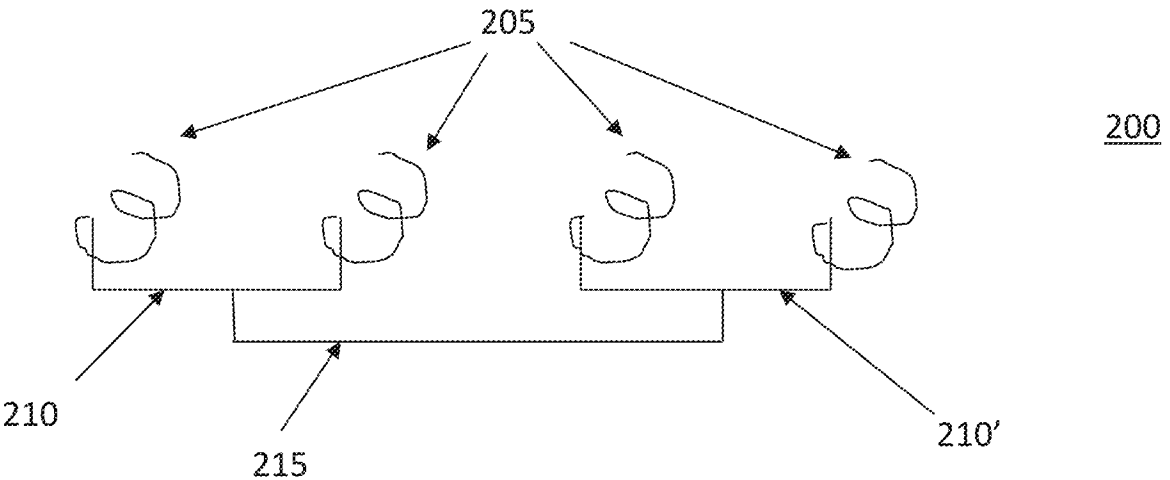
FIG. 2 depicts a 4 element sub-array.

FIG. 2 illustrates an embodiment of a 4 element sub-array (200). The sub-array (200) comprises 4 helical elements (205), made, for example, of 20 AWG copper wires. Each element (205) is suspended at a specific height so as to produce an input impedance of 200 Ohm. The 4 elements (205) are connected in pairs, one pair by a 200 Ohm transmission line (210) and the other pair also by a 200 Ohm transmission line (210').

The two transmission lines (210, 210') are connected by a 100 Ohm transmission line (215). The material and impedance values used in FIG. 2 are not intended as limiting and other conducting materials or impedance values may be used.

The transmission line (215) may be connected to the rest of the antenna system, for example by soldering the center pin of a coaxial RF connector, such as a subminiature version A (SMA) connector, to the line (215). The exact position where to solder a connector may be chosen so as to produce a desired element phasing for sub-array (200).

In another embodiment, a phased array antenna comprises 15 conical spiral elements arranged in 3 sub-arrays of 5 elements each, with the antenna elements individually oriented to point in a specific direction, in such a way as to produce the desired gain pattern.

In different embodiments, each sub-array may be connected to separate receivers, in order to allow the radio wave beam to be digitally steered over a wide range of angles.

Figure 3:
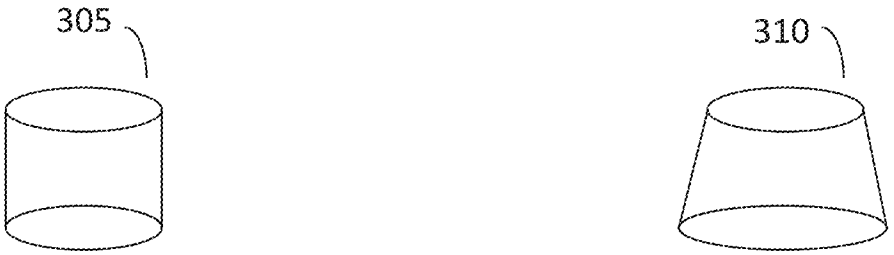
FIG. 3 depicts exemplary winding supports.

As illustrated in FIG. 3, in some embodiments helical antenna elements may be fabricated by winding a conducting wire on cylindrical supports (305), while in other embodiments conical spiral elements may be fabricated by winding a conducting wire on conical supports (310). Other shapes and configurations may be used. In other embodiments, a flat conducting ribbon may be used in place of a conducting wire.

The supports (305, 310) constitute the support elements of the phased array antenna. The support element may be cylindrical or conical, or having other shapes. The conducting wire, or flat ribbon, which is wound on the support elements is the part that actually emits or receives electromagnetic waves. Therefore, the part of the conducting wire which is wound on a support element may be termed an active element. The phased array antenna then comprises an array of support elements, on which a conducting wire is wound to form an array of active elements.

Figure 4:
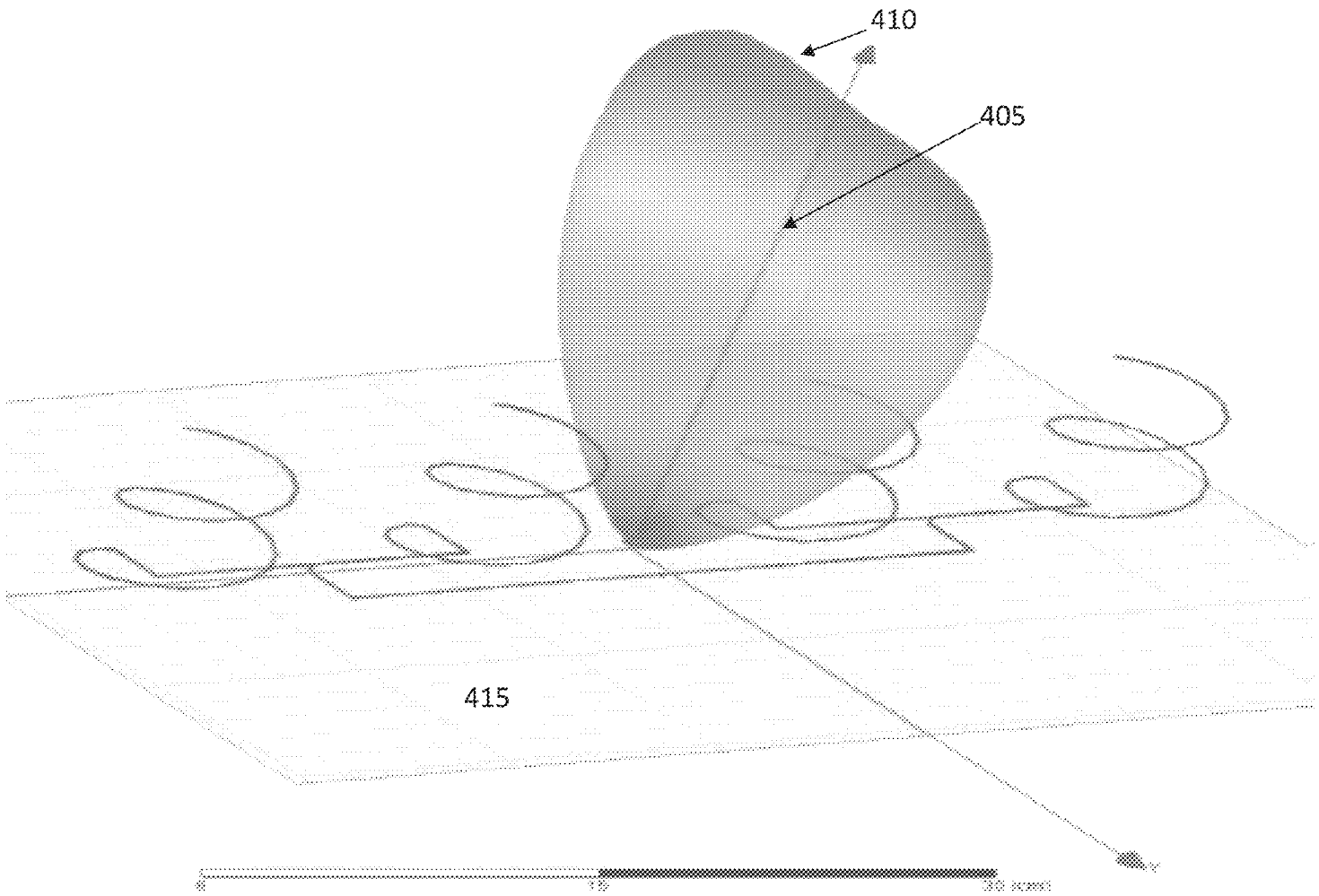
FIG. 4 depicts an exemplary embodiment of a sub-array with related gain pattern.

FIG. 4 depicts a gain pattern (405) for the phased array antenna of FIG. 2. It can be seen in FIG. 4 that this specific example of gain pattern (405) is highly directional along the z (vertical) axis (410).

As known to the person skilled in the art, oftentimes an impedance transforming network is used with antenna systems. Such networks are often lossy and narrowband. In an example embodiment of the present disclosure, the use of such a network can be avoided by proper design of the impedance of the antenna elements. These impedances can be chosen by taking into consideration the number of elements in each sub-array and the desired total output impedance for the antenna. For example, the antenna output impedance may be set as equal to the impedance of each element divided by the number of elements. This follows from basic circuit theory: the total impedance of a number of elements connected in parallel, each element having the same impedance, is simply the element impedance divided by the number of elements. For example, if the desired antenna output impedance is 50 Ohms, and the number of elements is 4, then the element impedance should be 200 Ohms.

In several embodiments of the present disclosure, it is possible to adjust the input impedance of each antenna element. For the embodiment with helical antenna elements, the impedance can be controlled by accurate selection of the thickness of the antenna wire, which will control the inductance of the element. The height of the antenna elements relative to the plane of the feed network is also designed to determine the desired impedance. As readily understood by the person skilled in the art, the height of the antenna elements also controls their shunt capacitance. In other words, the impedance of helical elements can be controlled by designing the thickness of the conducting wire, and the height of each element from the plane of the feed network.

As it is known in the art, helical antennas radiate in both a forward and backward direction, relative to their longitudinal axis. A metallic, signal reflecting, panel is used to reflect the backward transmission onto the opposite direction. The metallic panel is in the same plane of the combiner network.

Another embodiment comprises bifilar conical logarithmic-spiral elements. For this embodiment, the element impedance can be controlled by changing the offset angle used in winding the conducting element around the conical support.

As known in the art, logarithmic-spiral antennas do not radiate in the backward direction relative to their longitudinal axis. Therefore, a metallic reflecting panel is not needed. In one embodiment, the logarithmic spiral elements are fabricated with a flat conducting ribbon. In one embodiment, the logarithmic-spiral shape is obtained by integrating to logarithmic spirals. As known in the art, a logarithmic-spiral antenna can be fabricated by integrating two equal logarithmic spirals, rotated 180 degrees to each other. A higher number of spirals may be integrated together, and the angle may also be varied to obtain different geometries for a logarithmic-spiral antenna element.

The angle which determines the degree that each spiral is rotated relative to the other is referred to as the offset angle. By controlling this angle, the impedance of the antenna element can be controlled. The offset angle determines the ratio between the area of the conical support that is covered by the conducting wire and the area of the conical support which is not covered. This ratio can also be termed as the conductor-area to air-area ratio, as intuitively understood. As known in the art, a bifilar winding comprises two closely spaced, parallel windings. The word bifilar describes a wire which is made of two filaments or strands. In other words, for conical, logarithmic spiral elements, the antenna impedance can be controlled by the offset angle. For example, using an offset angle which covers a high percentage of the conical support area with a conducting wire or ribbon would give a low impedance for the antenna element.

The high degree of impedance control available in the present disclosure can avoid over reliance on traditional impedance matching techniques, which add complexity, weight, and cost, as well as negatively contributing to the efficiency of the antenna. Therefore, especially for astronautical applications, the methods of fabrication of the present disclosure advantageously include a high degree of impedance control.

Another design element of the fabrication method of the present disclosure relates to the transmission line. As known to the person skilled in the art, a transmission line can be used with antenna systems to connect different parts of the system. Such transmission lines can introduce loss due to unwanted signal reflections. In the present disclosure, it is possible to avoid unwanted reflections by matching the type of transmission line used in the combiner network and the antenna elements. For helical antenna elements, the same type of conductor wire may be used to realize both the helical antenna elements and the single-ended transmission line which lies in the feed network plane. As it is known to the person skilled in the art, the in-plane transmission line for the feed network is termed wire-above-ground plane-transmission line. For example, referring to FIG. 4, the gray-shaded plane (415) is the feed network plane.

For the embodiment with bifilar conical logarithmic-spiral elements, the transmission line comprising the feed network may be realized with the same bifilar conducting wire as that used to realize the conical spiral elements. Two flat conducting ribbons may be used instead of the conducting wire. By matching the transmission line for the feed network and antenna elements in this way, unwanted reflections (and related losses) due to mismatching transmission lines can be avoided.

An important parameter which describes the performance of an antenna is the antenna aperture. The antenna aperture measures how effective an antenna is at receiving radio waves. In the present disclosure, it is possible to maximize the antenna aperture by using antenna elements that don't require a ground plane, such as bifilar or quadrifilar conical logarithmic-spiral elements. As intuitively understood, quadrifilar wires are similar to bifilar, but with four, rather than two, strands. Such conical spiral element may be spaced as far as allowed by the physical dimensions of the antenna envelope—in other words, the physical dimensions available in the antenna to contain the array of antenna elements. The gain of each element can then be adjusted so that the resulting effective aperture for the phased array antenna densely fills the available physical envelope.

A possible advantage of conical spiral elements is that they don't require a ground plane, contrary to the helical elements. The reason is that the conical spiral elements don't emit in backward direction, therefore a metallic, reflecting, ground plane is not needed. Therefore, they can be spaced further apart and can be tilted in a desired direction. As a consequence, the effective aperture of the antenna can be maximized with respect to the physical space available. For specific astronautical missions, it may then be advantageous to use conical spiral elements as they can be tilted to obtain an antenna which is both compact and directional. Helical elements can also be tilted, but for certain applications, with a limited volume available, such tilted helical elements may not be as efficient as the conical elements.

In several astronautical missions, antenna design has to operate within set constraint. For example, the antenna may have to protrude vertically from a surface of a satellite, but the direction of the GNSS signals may be at an angle from the vertical direction of the satellite surface assigned to the antenna. For example, in a specific mission, the direction of the GNSS signal to be received (in the direction of the Earth's horizon), may be 22 degrees off the vertical. In such a case, it may be advantageous to fabricate a phased antenna array with tilted elements.

In some embodiments, each sub-array may be tilted in a different direction, for example one central sub-array in a vertical direction (normal to the ground plane), and the left and right sub-arrays angled to the left and right, respectively. In other embodiments, all elements and sub-arrays may be tilted in a common direction, for example towards the Earth's horizon. In yet other embodiments, more complex angling may be preferred.

Figure 5:
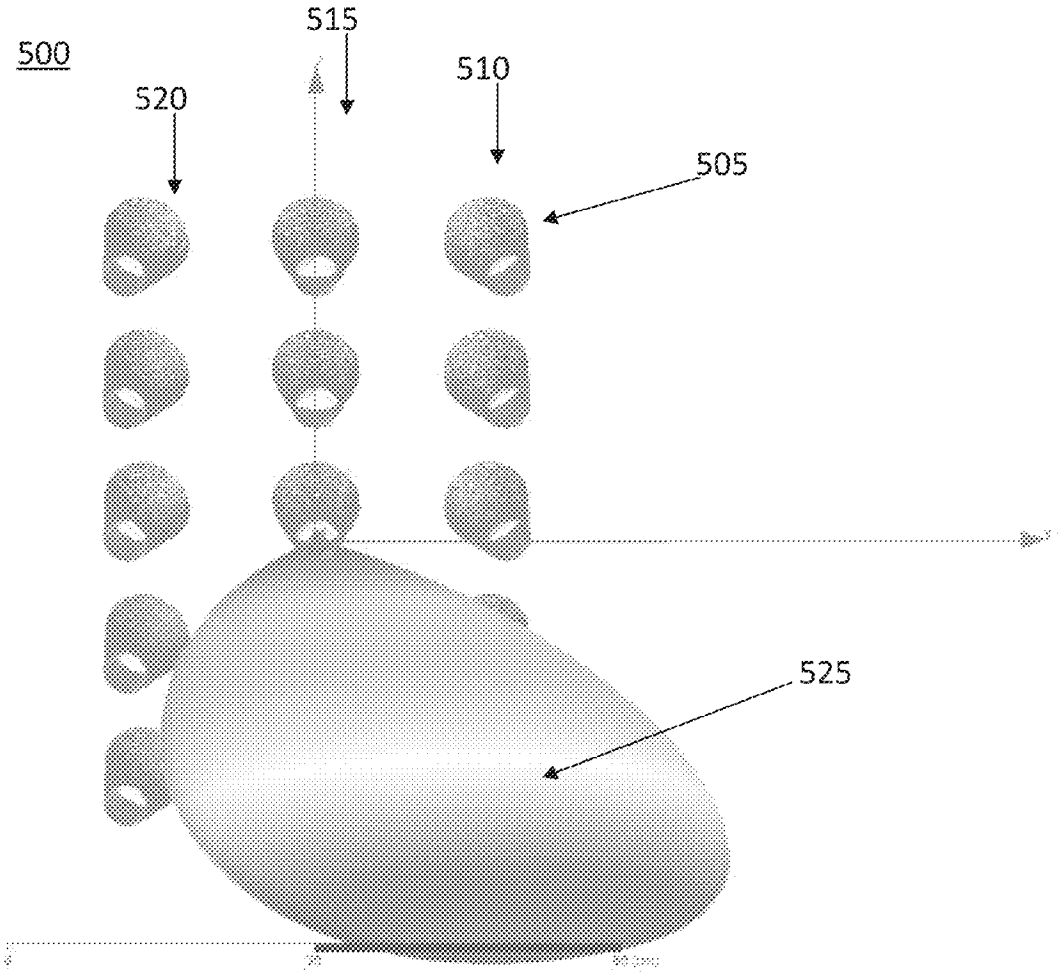
FIG. 5 depicts an exemplary 15 element conical array.

FIG. 5 illustrates an example embodiment of a phased array antenna (500) which maximizes the effective aperture with respect to the physical envelope (volume constraint). The phased array antenna (500) comprises 15 conical logarithmic-spiral elements (505), divided into 3 sub-arrays: right (510), middle (515) and left (520) columns. The zenith direction lies in the plane of the array (500). Each sub-array is steered in the direction of the Earth's limb (the horizon), therefore the gain peaks for each sub-array point to the direction of the Earth's limb. Each of the gain peaks also points to a different azimuth direction: −16, 0, and 16 degrees. The gain pattern (525) in FIG. 5 is that of the right sub-array (510) only.

Figure 6:
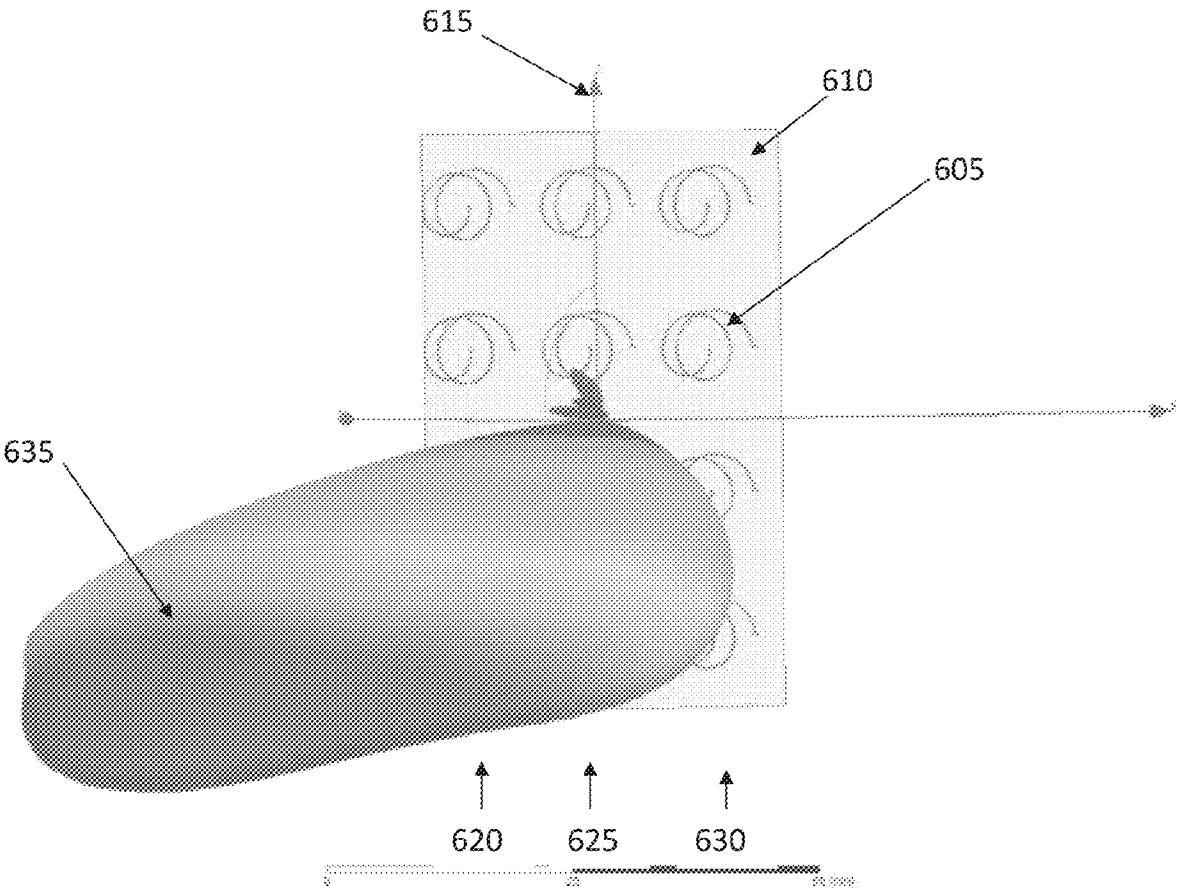
FIG. 6 depicts an exemplary 12 element helical array.

According to several embodiments of the present disclosure, it is possible for the phased array antenna to have a directivity pattern whose gain peaks are distributed along the limb of the Earth. FIG. 6 depicts a phased array antenna whose helical elements (605) are located on a ground plane (610). The main axis of alignment (615) (the z axis) is pointed in the direction of the zenith. The 12 helical elements are divided into 3 sub-arrays: left (620) column, mid (625) column and right (630) column. Each of the 3 sub-arrays (620, 625,630) can be steered in the direction of the Earth's limb. In FIG. 6, the beam profile (635) of the mid array (625) only is depicted, pointing towards the left (the Earth's limb in this example).

Figure 7:
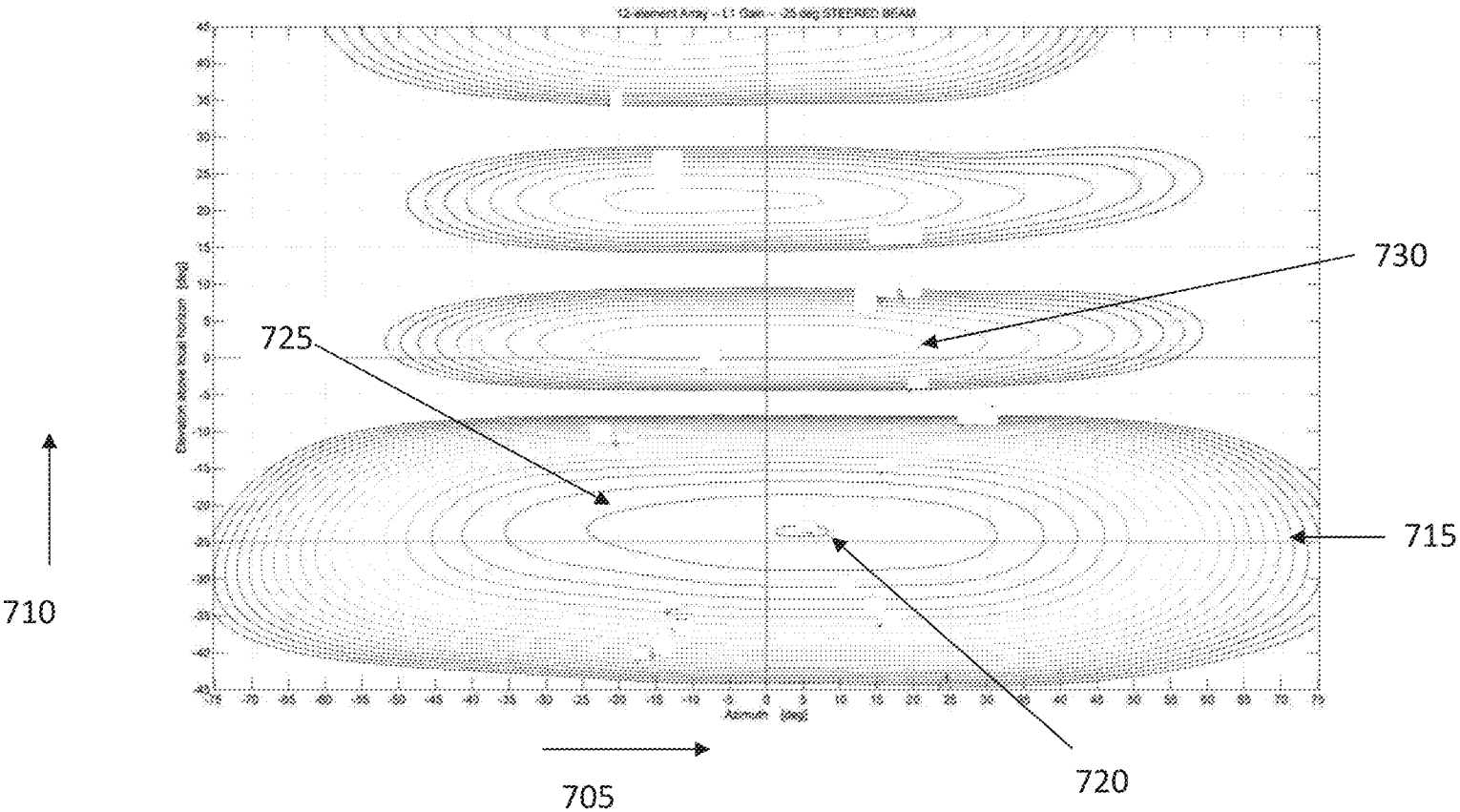
FIG. 7 depicts a gain contour plot for a 12 element array.

The beam profile (635) of FIG. 6 for the 12 element helical array is depicted in a different coordinate system in FIG. 7. The coordinate for the horizontal axis (705) of the graph in FIG. 7 is the azimuth, while the coordinate for the vertical axis (710) of the graph in FIG. 7 is the elevation above local horizon. The horizontal line (715) corresponds to the limb of the Earth. In the gain contour plot of FIG. 7, the gain peak (720) is located very close to the direction of the Earth's limb (715). The contour line for gain peak (720) has a value of 18. Each successive line radiating outward from the gain peak (720) has a value decreased by 1. Therefore, line (725) has a value of 17, and so on. The contour lines for the other lobes of the beam profile have lower values, for example line (730) has a value of 8.

Figure 8:
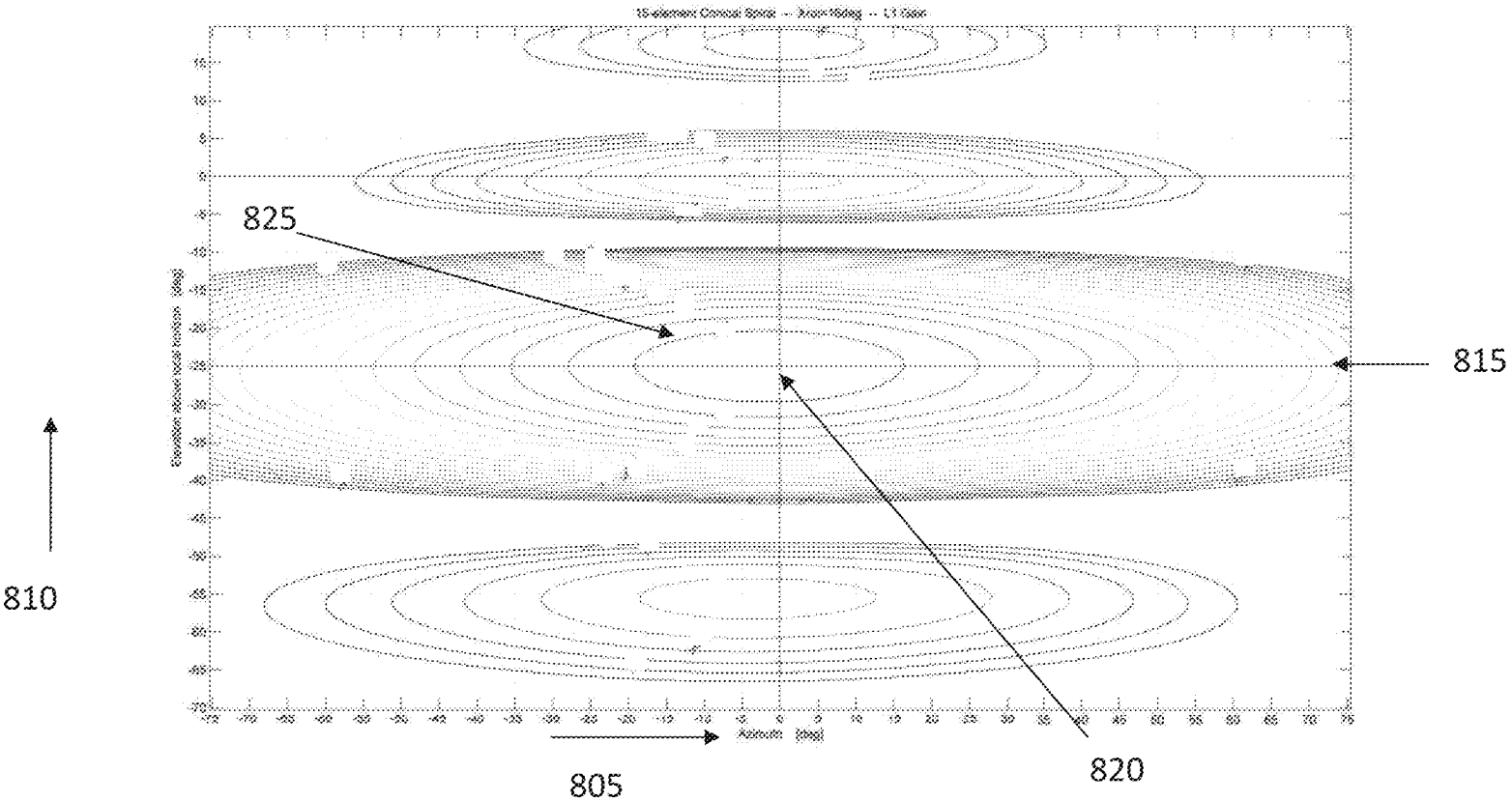
FIG. 8 depicts a gain contour plot for a 15 element array.

By comparison, the gain contour plot of a 15 element helical array is depicted in FIG. 8. Similarly to FIG. 7, in FIG. 8 the coordinate for the horizontal axis (805) of the graph in FIG. 8 is the azimuth, while the coordinate for the vertical axis (810) of the graph in FIG. 8 is the elevation above local horizon. The horizontal line (815) corresponds to the limb of the Earth. In the gain contour plot of FIG. 8, the gain peak (820) is located very close to the direction of the Earth's limb (815).

In this embodiment, the 15 element array antenna of FIG. 8 yields a higher gain over a greater azimuth range when compared to the embodiment of a 12 element array of FIG. 7. In fact, line (825) has a value of 19 (the following lines decrease in value as in FIG. 7). As can be calculated from the contour plots of FIGS. 7 and 8, an increase of 2 dB is obtained at 0 azimuth degrees, and an increase of 4 dB is obtained at 55 azimuth degrees.

According to several embodiments of the present disclosure, it is possible to maximize the gain along the limb of the Earth by orienting the antenna elements of an array in such a way as to point their beams towards the direction of the Earth's limb. Depending on the requirements on the field of view width of the antenna, the elements can also be oriented along different azimuthal angles. For example, in FIG. 5 the sub-array (520) is angled towards the left, and the sub-array (510) is angled towards the right. For one embodiment for a specific astronautical mission, the required specification is for the antenna to be able to receive signals at a 55 degrees angle to either side of the main peak direction. For other applications, the degree width may be varied.

By varying the geometry of the antenna elements, it may also be possible to optimize the total collection area of the antenna by tuning the directivity of the individual elements or sub-arrays. For example, if the phased antenna array comprises 12 elements, the collection area for each element may be set at slightly above 1/12th of the total collection area of the antenna. Ideally, no overlap would be necessary between the collection areas of the individual elements, however a small amount of overlap may be desirable to offset possible inefficiencies in the signal collection. As known in the art, there is a trade-off in antenna design between collection area and directivity. Therefore, if one were to increase the collection areas of the individual elements in order to have a large overlap, the directivity of the elements would decrease in turn. Careful design can determine, for a specific astronautical application, the optimal trade-off between collection area and directivity. In any case, for optimal antenna efficiency, the total available antenna area should be covered by sum of the collection areas of the individual elements.

Figure 9:
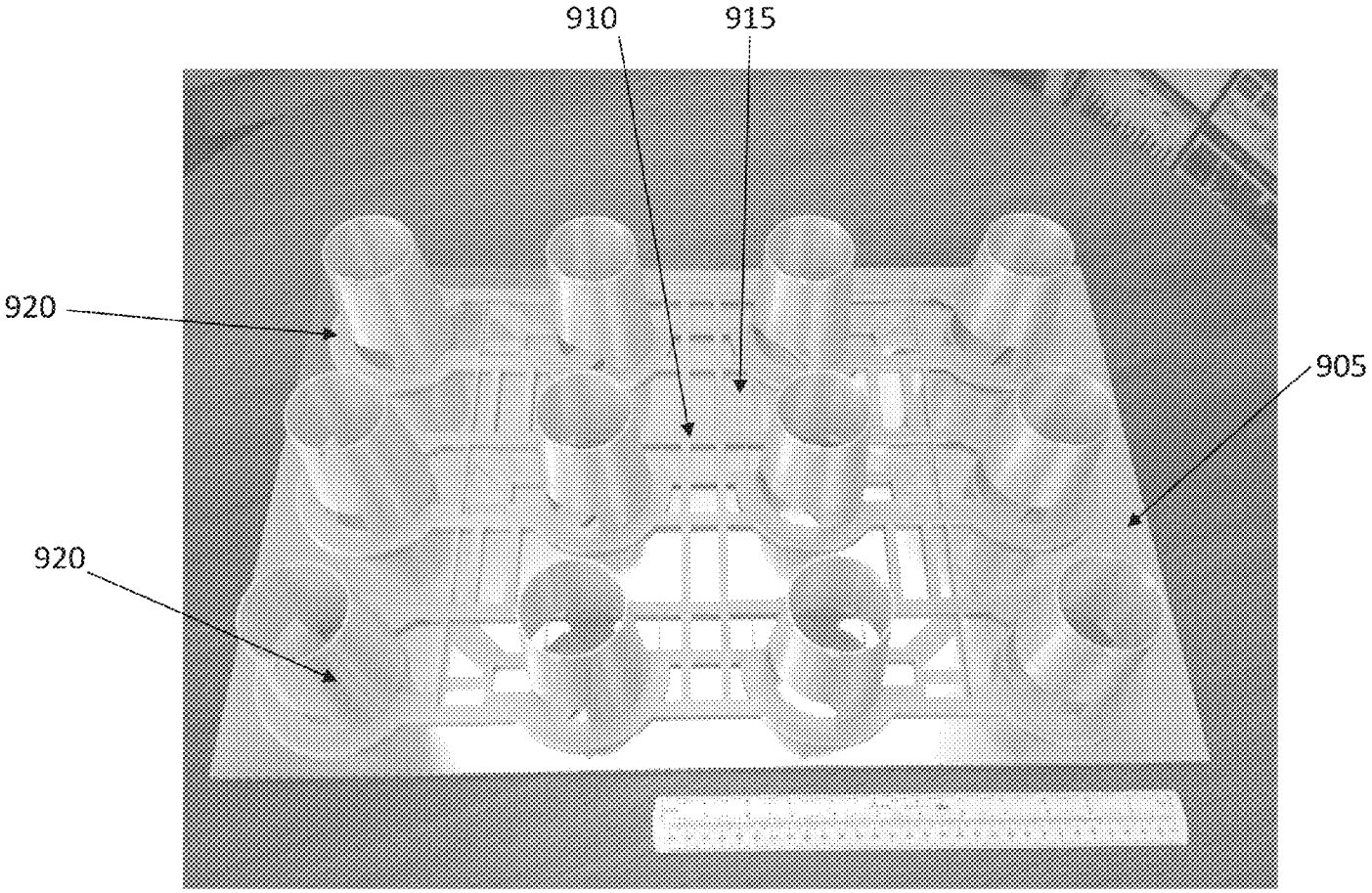
FIG. 9 depicts an exemplary 3D printed phased array antenna.

The phased array antennas of the present disclosure may be constructed at a low to moderate cost, thanks to the inexpensive design, components and assembly. Several components may be constructed using 3D printing processes. In order to fabricate a support structure for the combiner network and the antenna elements which is lightweight, a complex geometry is most effective. For example, as visible in FIG. 9, the support structure in the ground plane (905) is not a simple sheet of material, but it comprises connective beams (910) and empty spaces (915). Traditional manufacturing techniques such as machining or injection molding would produce many separate complex parts and require expensive assembly and manufacture.

By using for example 3D printing, it is possible to fabricate a complete support structure in a single piece. By using this method, a phased array antenna can be fabricated with a limited number of components, comprising, by way of example and not of limitation, a 3D printed support structure (920), an aluminum honeycomb panel (905), conducting wire (920), fasteners and connectors. For example, the support structure (920) was fabricated with ULTEM, a polyetherimide-based thermoplastic material, by the fused deposition modeling (FDM) process, a 3D printing technique. The aluminum panel (905) is a ¼" aerospace-grade honeycomb panel.

The mechanical strength and thermal properties of the plastic used in 3D printing are important, as the antenna should be space-worthy. In particular, highly reactive oxygen atoms are present at the operating height of several satellites. Said atoms could attack the plastic support structure of an antenna to negative effect. To protect against oxygen atoms and ultraviolet (UV) radiation, a pain can be applied to the plastic three-dimensionally printed structure. For example, variations of the S13G white paint are regularly used for astronautical applications by NASA. Such paints are non-conductive and have low solar absorbance. A characteristic of this type of protective paint is that it forms a glass-like layer on the plastic structure, thereby protecting it. Being of white color, a high percentage of solar radiation can be reflected, optimizing thermal control of the antenna operating conditions.

Through several embodiments of the methods of the present disclosure, a phased antenna array is fabricated achieving great efficiency in a limited volume constraint. A high efficiency may be obtained by optimizing the geometrical structure through the use of 3D printing, as well as optimizing the electrical efficiency of the antenna active components, by providing a comprehensive, integrated design for the combiner network and antenna elements. In some embodiments, the height and width of the support elements can be optimized to achieve a high efficiency.

The examples set forth above are provided to those of ordinary skill in the art a complete disclosure and description of how to make and use the embodiments of the gamut mapping of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

What is claimed is:

1. A phased array antenna comprising:

a three-dimensionally printed support structure, wherein the support structure comprises a base structure lying on a ground plane, and an array of support elements protruding away from the ground plane;

an array of active elements, comprising a first conducting wire wound around the array of support elements, wherein a phase of a radio wave emitted by the active elements of the array of active elements is adjustable; and a combiner network, comprising a second conducting wire connecting to the first conducting wire, configured so that a beam pattern of the radio wave can be steered in a desired direction by way of phase adjustment.

2. The phased array antenna of claim 1, wherein the support elements of the array of support elements have a cylindrical and/or conical shape.

3. The phased array antenna of claim 1, wherein the first conducting wire is wound in a helical and/or logarithmic spiral shape.

4. The phased array antenna of claim 1, wherein the first conducting wire and the second conducting wire are of the same material and have the same electrical resistance.

5. The phased array antenna of claim 1, wherein each support element of the array of support elements is angled in a different direction.

6. The phased array antenna of claim 1, wherein the phased array antenna is configured to produce circularly polarized radio waves.

7. The phased array antenna of claim 1, wherein distance and geometry of the array of support elements are optimized for broadband signaling, high efficiency, low mutual coupling, and large effective aperture.

8. The phased array antenna of claim 1, wherein distance and geometry of the array of support elements are function of a desired impedance.

9. The phased array antenna of claim 1, wherein distance and geometry of the array of support elements are function of a desired gain peak and/or directivity.

10. The phased array antenna of claim 1, wherein distance and geometry of the array of support elements is optimized to receive GNSS signals.

11. The phased array antenna of claim 1, wherein the array of support elements is divided into sub-arrays individually controllable by the combiner network.

12. The phased array antenna of claim 1, wherein the first and second conducting wires are bifilar or quadrifilar.

13. The phased array antenna of claim 1, wherein a thickness of the first conducting wire is function of a desired inductance of the phased array antenna.

14. The phased array antenna of claim 1, wherein a distance between the array of active elements and the ground plane is function of a desired capacitance of the phased array antenna.

15. The phased array antenna of claim 1, wherein an area of the array of support elements covered by the first conducting wire is function of a desired impedance of the phased array antenna.

16. The phased array antenna of claim 1, wherein the three-dimensionally printed support structure is made of fused-deposition-modeled thermoplastic materials.

17. The phased array antenna of claim 1, further comprising an aluminum honeycomb panel onto which the three-dimensionally printed support structure is affixed.

18. The phased array antenna of claim 17, wherein the aluminum honeycomb panel has a thickness of ¼".

19. A method for radio occultation measurements, the method comprising:

providing the phased array antenna of claim 1; and controlling phase and amplitude of electrical signals connected to the phased array antenna, thereby controlling gain and directivity of the phased array antenna.

20. A method for fabricating the phased array antenna of claim 1, the method comprising:

three-dimensionally printing a support structure with a thermoplastic material, the support structure comprising:

an array of support beams lying in a ground plane;

an array of support elements protruding in a direction not lying in the ground plane, wherein the support elements are angled at a desired direction configured to obtain a desired beam pattern for a radio wave emitted and/or received by the phased antenna array;

covering the support structure with a reflective, non solar-radiation absorbing, UV resistant paint;

winding a first conducting wire around the array of support elements, thereby obtaining an array of active elements;

connecting the active elements through a second conducting wire, thereby obtaining a combiner network.

* * * * *